US005605395A

United States Patent [19]

Peng

[11] Patent Number: 5,605,395

[45] Date of Patent: Feb. 25, 1997

[54] STRUCTURE OF CHRISTMAS TREE LIGHT

[76] Inventor: Juei-Tang Peng, No. 312, Yen Ping Rd., Sec. 3, Hsinchu City, Taiwan

[21] Appl. No.: 664,426

[22] Filed: Jun. 18, 1996

[51] Int. Cl.[6] ..... H01R 33/00

[52] U.S. Cl. ..... 362/226; 362/249; 362/294; 362/806

[58] Field of Search ..... 362/226, 237, 362/249, 806, 294, 373

[56] References Cited

U.S. PATENT DOCUMENTS

| | | | |
|---|---|---|---|
| 4,999,751 | 3/1991 | Chen | 362/226 |
| 5,331,529 | 7/1994 | Huang | 362/294 X |
| 5,361,192 | 11/1994 | Lai | 362/806 X |

*Primary Examiner*—Stephen F. Husar
*Attorney, Agent, or Firm*—Morton J. Rosenberg; David I. Klein

[57] ABSTRACT

A Christmas tree light of the type including a downwardly-opened socket holder, a downwardly-opened lamp socket mounted in the socket holder, two electric wires having a respective metal terminal respectively mounted in the socket holder, and a bulb mounted in the lamp socket and having two electric contact legs respectively disposed in contact with the metal terminals of the electric wire, wherein the lamp socket is a downwardly-opened, hollow taper shell having an outward annular flange raised around the periphery of the bottom open end, and two longitudinal splits disposed at two opposite sides and respectively intersecting the outward annular flange; the socket holder has two longitudinal grooves bilaterally disposed on the inside and respectively disposed in communication with the longitudinal splits of the lamp socket and adapted for guiding out water and snow that passes to the inside of the socket holder out of the lamp socket through the long longitudinal splits thereof.

1 Claim, 6 Drawing Sheets

STRUCTURE OF CHRISTMAS TREE LIGHT

BACKGROUND OF THE INVENTION

The present invention relates to Christmas tree lights, and relates more particularly to such a Christmas tree light which fits the manufacturing tolerance of the bulb and which has water guide means to guide out water and snow.

FIG. 6 is a cross sectional view of a Christmas tree light according to the prior art. This structure of Chrismas tree light comprises a downwardly-opened socket holder (3') having two wire holes (31') at the top, two electric wires (3',4') having a respective metal terminal (41',51') respectively inserted through the wire holes (31') into the inside of the socket holder (3'), a downwardly-opened lamp socket (2') mounted in the socket holder (3'), and a bulb (1') mounted in the lamp socket (2') and having two electric contact legs (11') respectively disposed in contact with the metal terminals (41',51') of the electric wires (4',5'). This structure of Christmas tree light is functional, however it still has drawbacks. Because the bulb (1') is made by blowing, a manufacturing tolerance on the outer diameter is not inevitable. If the outer diameter of the bulb (1') does not fit the inner diameter of the lamp socket (2') perfectly, the bulb (1') may be unable to be firmly retained to the lamp socket (2') if the outer diameter of the bulb (1') is too small, the bulb (1') or the lamp socket (2') may be forced to break upon the insertion of the bulb (1') into the lamp socket (2') if the outer diameter of the bulb (1') is too big. Another drawback of this structure of Christmas tree light is that water or snow tends to pass through the wire holes (31') to the inside of the socket holder (3') and to be accumulated in the space (W) defined within the socket holder (3') around the top end of the lamp socket (2'), thereby causing the metal terminals (41',50') of the electric wires (4,5) and the electric contact legs (11') of the 'bulb (1') to be dipped in water or snow. Furthermore, because the lamp socket (2') and the socket holder (3') are respectively molded from plastic, they tend to expand when hot, or shrink when cold. If the lamp socket (2') and the socket holder (3') are caused to deform, the lamp socket (2') may drop from the socket holder (3'). Therefore, this structure of Christmas tree light is not durable in use

SUMMARY OF THE INVENTION

The present invention has been accomplished to provide a Christmas tree light which eliminates the aforesaid drawbacks. It is one object of the present invention to provide a Christmas tree light which fits the manufacturing tolerace of the outer diameter of the bulb. It is another object of the present invention to provide a Christmas tree light which has guide means to guide out water and snow so as to prevent accumulation of water and snow on the inside. It is till another object of the present invention to provide a Christmas tree light which is durable in use. According to one aspect of the present invention, the lamp socket is a split taper shell that fits the manufacturing tolerance of the outer diameter of the bulb. According to another aspect of the present invention, socket holder is a hollow taper shell fitting the split taper shell of the lamp socket. Therefore, the lamp socket can be conveniently and smoothly plugged into the socket holder. Because the lamp socket has a split body, it is compressed inwards to hold the bulb firmly in place when it is inserted into the socket holder. According to still another aspect of the present invention, the socket holder has two longitudinal water guide grooves respectively disposed in communication with the splits of the lamp socket so that water and snow can be quickly guided out of the socket holder and the lamp socket.

DETAILED DESCRIPTION OF THE PREFERRED EMBODIMENT

Figure 1:
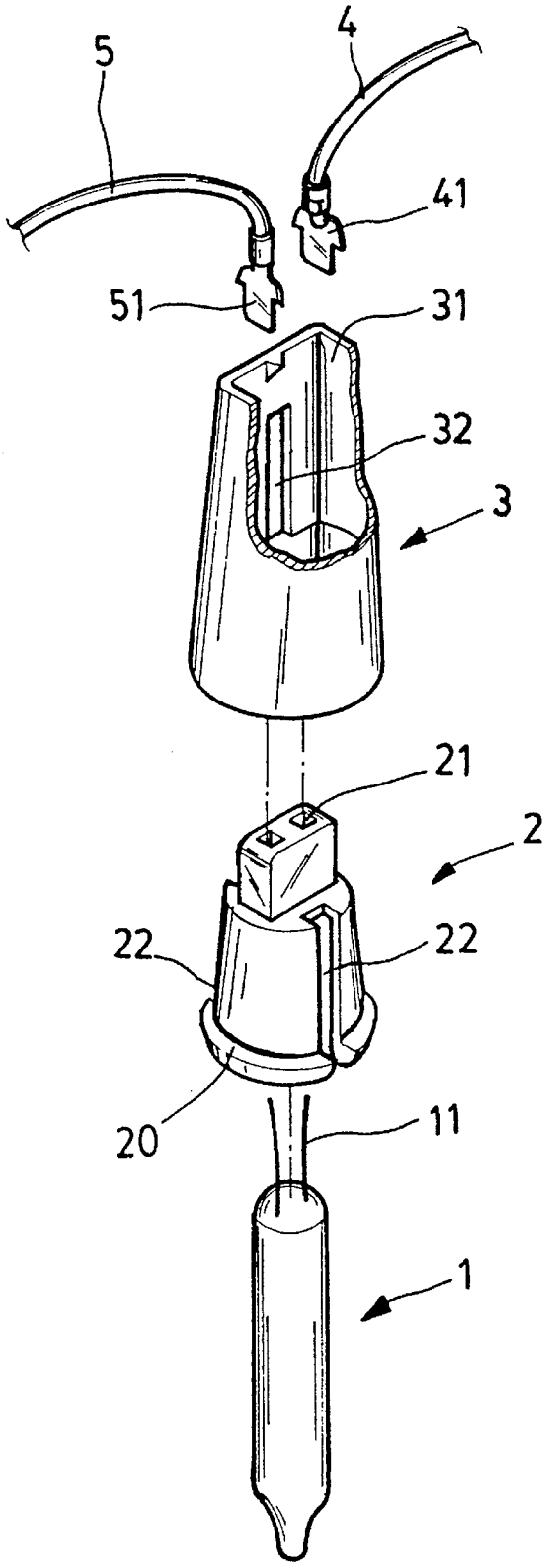
FIG. 1 is an exploded view of a Christmas tree light according to the present invention.

Referring to FIG. 1, a Christmas tree light in accordance with the present invention is generally comprised of a bulb 1, a lamp socket 2, a socket holder 3, and two electric wires 3,4. The bulb 1 has two electric contact legs 1 ! at one end. The lamp socket 2 is a downwardly-opened, hollow taper shell adapted for receiving the bulb 1, having wire holes 21 at the closed top end thereof for the passing of the electric contact legs 11 of the bulb 1. The socket holder 3 is a downwardly-opened, hollow taper shell adapted for holding the lamp socket 2. The top end of the socket holder 3 has a flat profile, and two parallel wire holes 31 longitudinally extending to the outside. The electric wires 4,5 have a respective metal terminal 41,51 at one end respectively inserted into the plug holes 31 of the socket holder 3 and forced into contact with the electric contact legs 11 of the bulb 1.

Referring to FIG. 1 again, the lamp socket 2 has a tapered profile with the diameter gradually reducing toward the top (the location of the wire holes 21, an outward annular flange 20 raised around the periphery of the open bottom end thereof, and two longitudinal splits 22 disposed at two opposite sides and respectively intersecting the outward annular flange 20. The socket holder 3 has two longitudinal water guide grooves 32 bilaterally disposed on the inside corresponding to the longitudinal splits 22 of the lamp socket 2.

Figure 2:
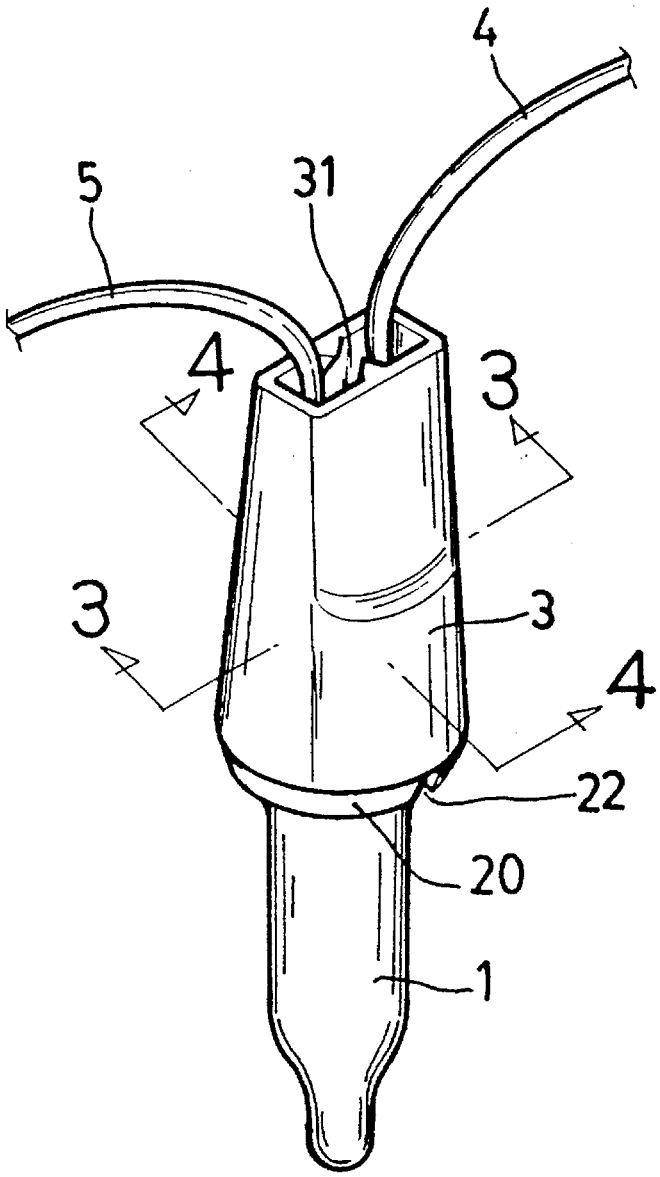
FIG. 2 is an elevational view of the present invention showing the Christmas tree light assembled
Figure 3:
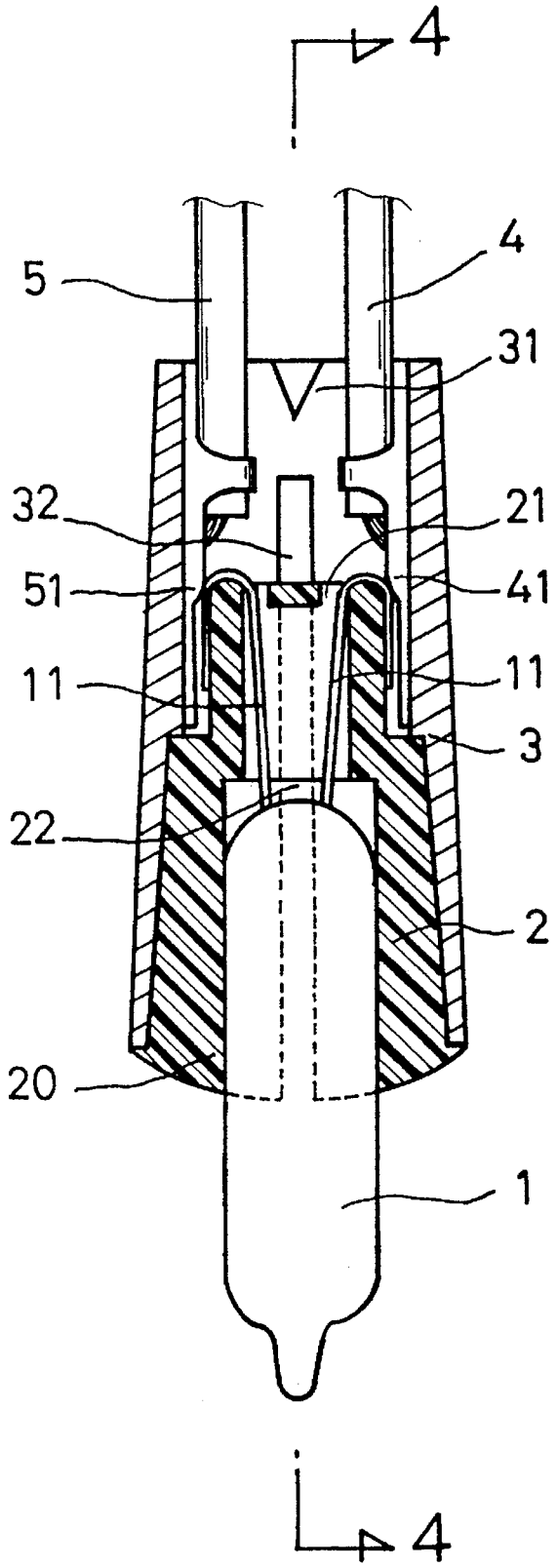
FIG. 3 is a sectional view taken along line 3—3 of FIG. 2.
Figure 4:
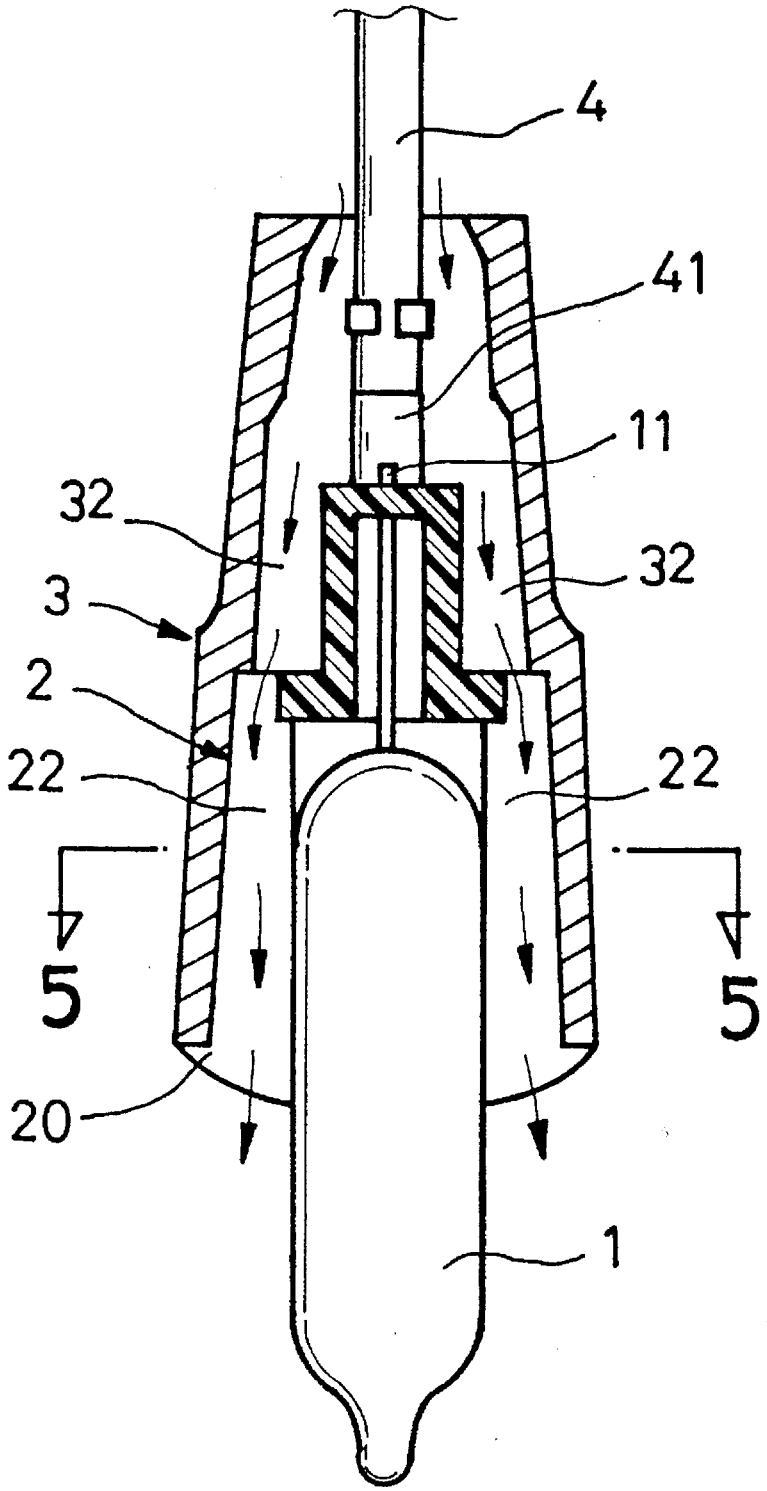
FIG. 4 is a sectional view taken along line 4—4 of FIG. 2.

Referring to FIGS. 2, 3 and 4 when the bulb 1 is inserted into the lamp socket 2, the electric contact legs 11 are inserted through the wire holes 21, then bent backwards and closely attached to the flat top of the lamp socket 2 at two opposite sides. Because of the design of the longitudinal splits 22, the lamp socket 2 automatically compensates for the manufacturing tolerance of the bulb 1. Therefore, the bulb 1 can be plugged into the lamp socket 2 smoothly without causing the lamp socket 2 to be forced to break. When the electric wires 4,5 are respectively inserted into the wire holes 31 of the socket holder 3, the lamp socket 2 is inserted into the socket holder 3, and the metal terminals 41,5, of the electric wires 4,5 are retained in contact with the electric contact legs 11 of the bulb 1.

Figure 5:
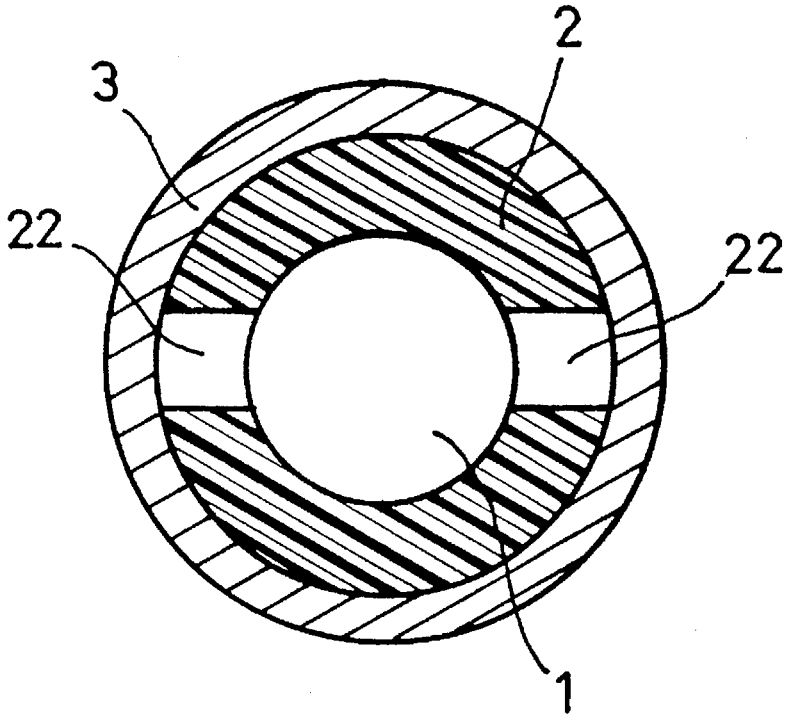
FIG. 5 is a sectional view taken along line 5—5 of FIG. 4.
Figure 6:
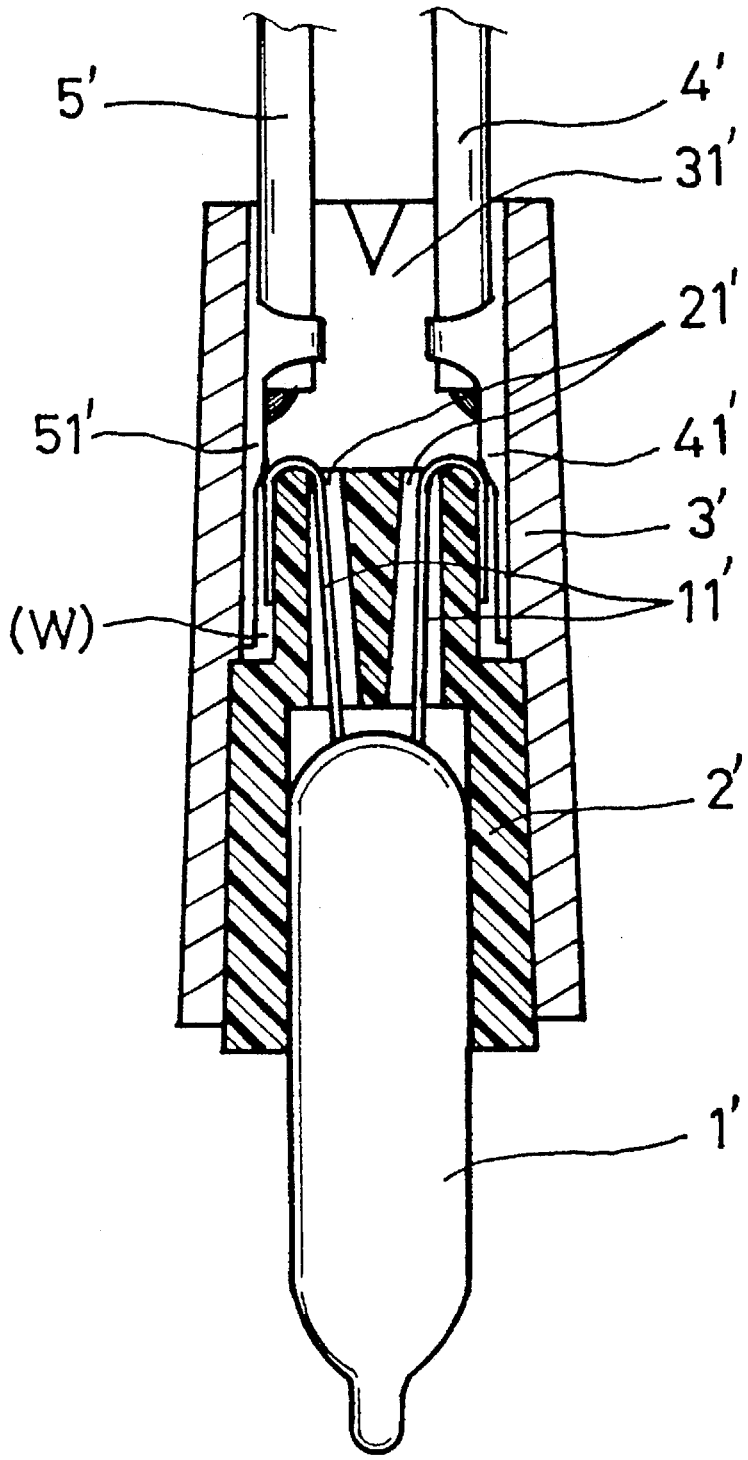
PRIOR ART FIG. 6
FIG. 6 is a sectional assembly view of a Christmas tree light according to the prior art.

Referring to FIG. 5 and FIG. 4 again, when the Christmas tree light is assembled, the longitudinal water guide grooves 32 of the socket holder 3 are respectively disposed in communication with the longitudinal splits 22 of the lamp socket 2. If water or snow passes from the wire holes 31 to the inside of the socket holder 3, it will be guided downwards by the longitudinal water guide grooves 32 to flow out of the lamp socket 2 through the longitudinal splits 22. Therefore no water or snow will be accumulated inside the Christmas tree light, or adhered to the metal terminals 41,51 of the electric wires 4,5, or the electric contact legs 11 of the bulb 1.

While only one embodiment of the present invention has been shown and described, it will be understood that the drawings are designed for purposes of illustration only, and are not intended as a definition of the limits and scope of the invention disclosed.

What the invention claimed is:

1. A Christmas tree light comprising a downwardly-opened socket holder, a lamp socket mounted in said socket holder and having a bottom open end, two electric wires having a respective metal terminal respectively mounted in said socket holder, and a bulb mounted in said lamp socket and having two electric contact legs respectively disposed in contact with the metal terminals of said electric wire, wherein said lamp socket is a downwardly-opened, hollow taper shell having an outward annular flange raised around the periphery of the bottom open end thereof and two longitudinal splits disposed at two opposite sides and respectively intersecting said outward annular flange; said socket holder has two longitudinal grooves bilaterally disposed on the inside and respectively disposed in communication with the longitudinal splits of said lamp socket and adapted for guiding out water, snow that passes to the inside of said socket holder out of said lamp socket through said longitudinal splits.

* * * * *